US007293730B2

(12) United States Patent
Jonkka

(10) Patent No.: US 7,293,730 B2
(45) Date of Patent: Nov. 13, 2007

(54) KNIFE FIXING METHOD

(75) Inventor: Arvo Jonkka, Pori (FI)

(73) Assignee: Metso Paper, Inc., Helsinki (FI)

( * ) Notice: Subject to any disclaimer, the term of this patent is extended or adjusted under 35 U.S.C. 154(b) by 171 days.

(21) Appl. No.: 10/547,090

(22) PCT Filed: Dec. 3, 2003

(86) PCT No.: PCT/FI03/00925

§ 371 (c)(1),
(2), (4) Date: Aug. 26, 2005

(87) PCT Pub. No.: WO2005/053924

PCT Pub. Date: Jun. 16, 2005

(65) Prior Publication Data

US 2006/0174973 A1 Aug. 10, 2006

(51) Int. Cl.
*B02C 18/18* (2006.01)

(52) U.S. Cl. ..... 241/286; 29/428; 241/294

(58) Field of Classification Search ..... 241/92, 241/294, 286; 144/176; 29/428
See application file for complete search history.

(56) References Cited

U.S. PATENT DOCUMENTS 5,129,437 A 7/1992 Nettles et al.
5,444,904 A 8/1995 Kokko
5,820,042 A 10/1998 Robison
6,056,030 A 5/2000 Jonkka

FOREIGN PATENT DOCUMENTS

DE 198 04 103 8/1999
GB 525010 3/1940

*Primary Examiner*—Mark Rosenbaum
(74) *Attorney, Agent, or Firm*—Buchanan Ingersoll & Rooney PC

(57) ABSTRACT

The present invention concerns a method for fixing a knife in wood chipper apparatuses over the whole knife length between two steady surfaces. The fixing force is developed by means of a roller chain located between two counter surfaces and reversing its direction at each of its couplings, the roller chain having stationary end rollers and intermediate rollers at the couplings, the intermediate rollers rolling during the press movement in the longitudinal direction of the chain. An external force is applied to the roller chain, the force changing its direction at the touching points of the rollers, so that the force applied to the roller chain affects to multiple points of the counter surfaces thus forming a prominent total pressing force.

21 Claims, 8 Drawing Sheets

KNIFE FIXING METHOD

Figure 1:
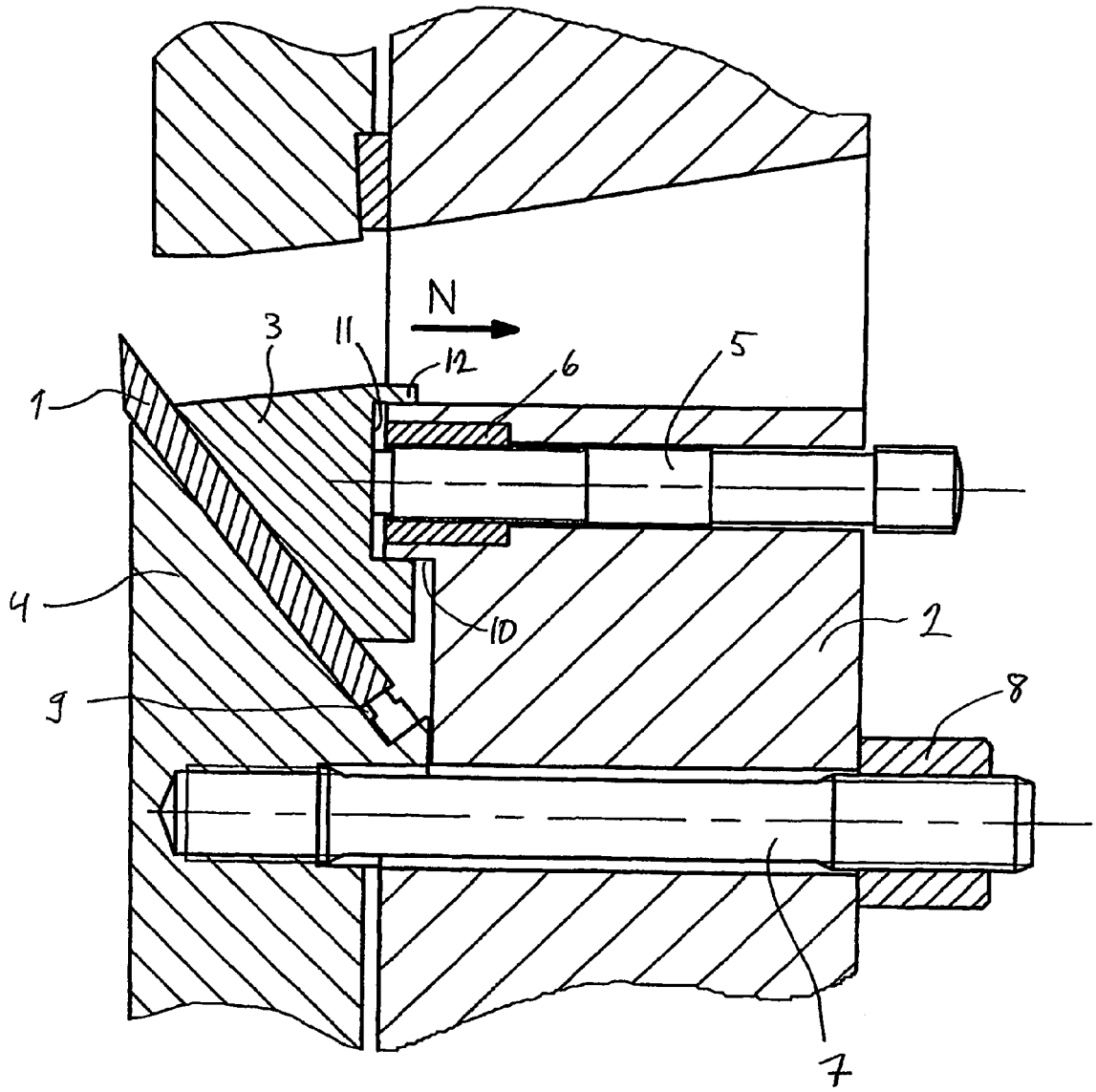

The present invention concerns a knife fixing of method for an apparatus being used for chipping wood, as well as a knife assembly utilizing the fixing method.

Disc chippers are generally used in the wood processing industry for chipping wood prior to the further processing. The rotating disc of a chipper is equipped with knives attached evenly distributed thereto and extending radially or slightly deviating from the radial position, said knifes cutting chips from a log against a counter knife. The knives are exposed to strong striking forces by the wood during the chipping, so that the attachment of the knives must be robust. The knife of the chipper and its attachment form a very important part of the operation of an apparatus used for chipping pulpwood. Due to relatively fast wearing of the knives, they must be easily and quickly changeable. It can be considered as an advantage of the knife system nowadays, if only one person is needed for changing the knives.

Traditionally one-part or multiple part knives are attached with bolts by pressing them to their respective knife recesses. In a multiple part knife system a knife recess is equipped with 2 to 3 consequent shorter knives. In order to ensure a firm attachment evenly along the total length of the knife, a one-part knife is attached with 6 to 7 bolts, depending on the size of the chipper. In a multiple part knife system, the biggest chippers have up to 12 to 16 bolts in one knife recess. A typical common pressure force of the bolts used in a one-part knife is about 300 kN. The big amount of fixing bolts is a result of relatively weak and flexible attaching elements. Flexible elements require a plurality of force application points or bolts. Too long distances between bolts lead to bending of fixing elements and breaking of the hardened knife.

There are 10 to 16 knife recesses in one chipper. For changing the knives, each bolt is opened, knives replaced by new ones and finally bolts fixed and tightened again. A disc chipper and a traditional knife fixing method have been described e.g. in the patents U.S. Pat. No. 5,129,437, U.S. Pat. No. 4,545,413 (FI 74901). For changing the knife, attendance is required on both sides of the knife disc. One person is able to change the knife, if the fixing bolts of the knife clamp are located to the front side of the knife disc, like e.g. in turn-over knife systems according to Patent EP 707529. In that case, however, changing of a knife takes longer time.

In an uninterrupted drive, the knives are changed in the Northern countries from 1 to 3 times per day. When processing tropical leave wood, the knives must be changed even after a drive of one hour. Changing knives that are attached with several bolts takes from half an hour to one hour. Thus, changing of the knives means a prominent yearly amount of man-hours and a production stop in the operation of a chipper plant.

One known fast-fixing method for the cutting tool in a turning apparatus is disclosed in the British publication 525010, the system consisting of two zig-zag chains and an expansion block, and utilizing one drive bolt. This system presupposes that the tool is fixed by compacting the longitudinal space reserved for the chains. Said system has, however, not gained any remarkable success due to the fact that the pressing distance required for the turning tool is comparatively short, and consequently the tightening can be achieved by means of a more simple assembly and one bolt.

Patent EP 0468458 discloses one method for simplifying and speeding up the changing of knives. In this method, the knife is pressed from its one side by means of a wedge-shaped knife clamp against a fixed counter surface on the opposite side of the knife recess. The wedge-shaped knife clamp tapering outwards from the front surface of the knife disc has an approximate width of the knife. Bolts at a certain distance from each other are fixed to the tapering end of the knife clamp. Springs are attached to the other ends of the bolts. The springs are supported to the knife disc, and the bolts draw the knife clamp by means of the spring force towards the bottom of a wedge-shaped knife recess, whereby the knife is secured in position by the pressing force applied by the knife clamp.

When changing the knifes, an external force opposite to the spring force is applied to the bolts fixed to the knife clamp, whereby the knife clamp rises and the pressing force applied to the knife is removed. The external force can be generated hydraulically or by means of an eccentric shaft in contact with each bolt. In both cases detaching or attaching the knife is relatively simple compared with the traditional method. One problem with the method is that it requires precise machining of the wedge-like knife clamp and its counter surfaces in the knife recess. In order to provide an adequate and evenly distributed pressing force against the knife over the total length of the knife, the machining tolerance requirement of the surfaces is high. It must be carefully taken into account, that an adequately strong spring force is provided and the friction on the slide surface controlled, in order to apply the required pressing force to the knife. Additionally, wood and other materials from the chipping process sticking to the surfaces of the knife recess cause problems. The method requires especially exact cleaning of the surfaces always when the knife is changed. Hydraulic operations also increase the cost of the knife disc.

Also in the patent U.S. Pat. No. 5,444,904, wedge forces are used for providing the pressing force to the knife. For applying the force evenly over the total length of the knife, also flexible elements are used in addition to the wedge-shaped surfaces. In this method also the machining tolerances, uniform flexibility of the elements and the alternating friction are problematic. Displacement of the knife clamp wider than normal is difficult to arrange, so that when implementing the invention for strongly shaped knives (turn knives), a cassette system had to be developed. In the method the strongly shaped knives are placed in a kind of a cassette, after which the cassette with its knives is placed in the knife recess.

An object of the present invention is to simplify changing of the knife and decrease the amount of involved work. The characteristics of the invention are presented in claims from 1 to 10.

Figure 2:
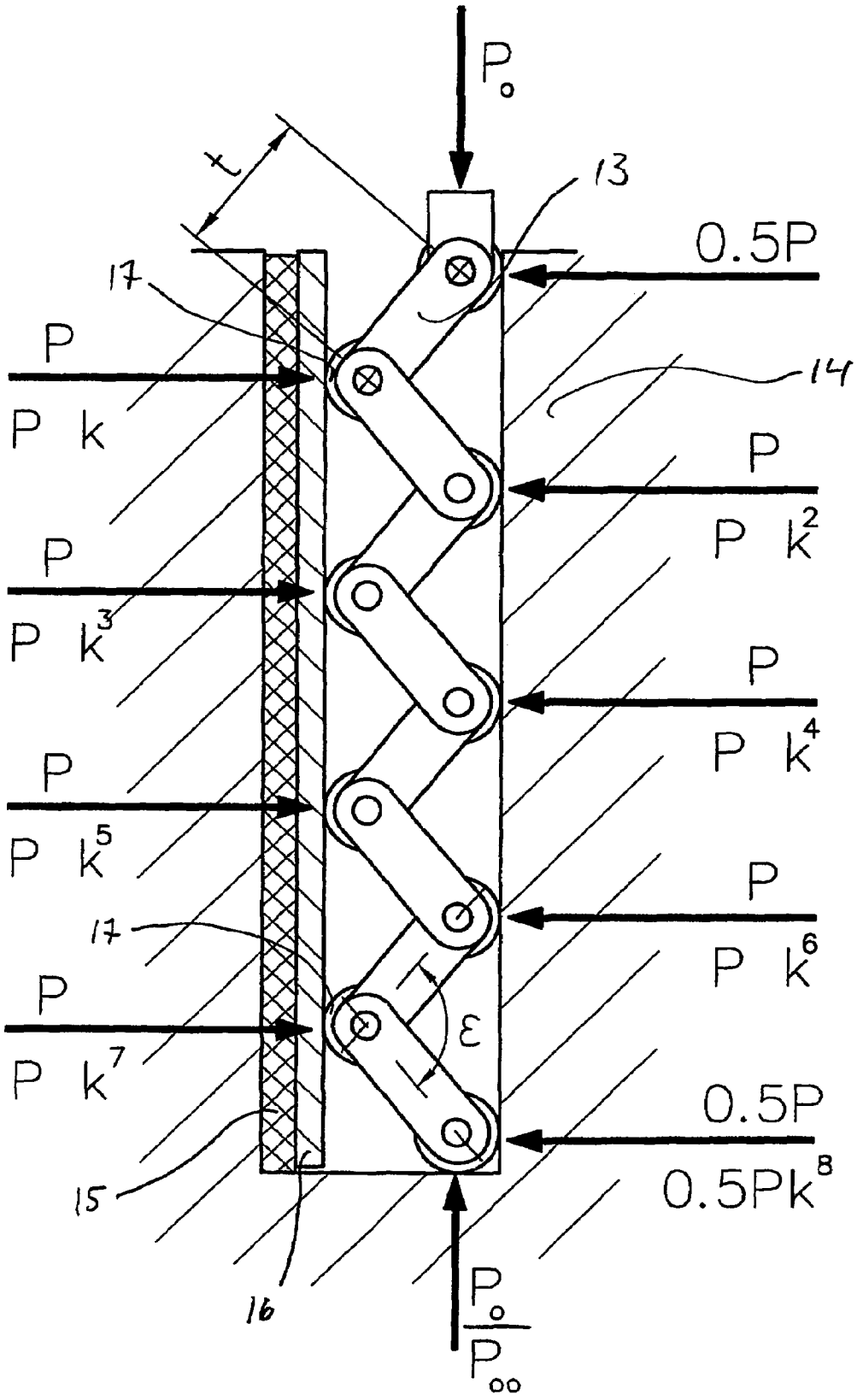
Figure 3:
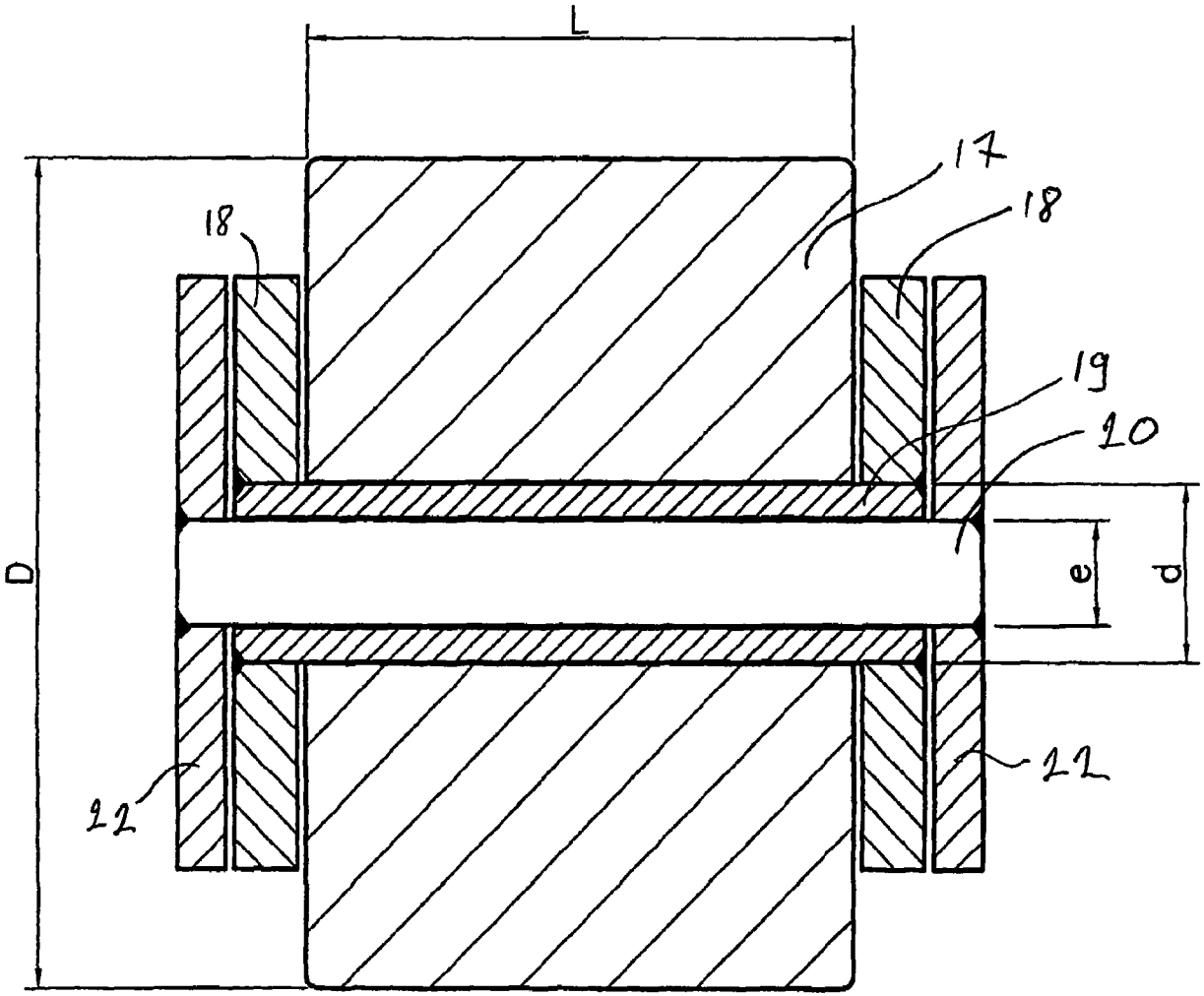
Figure 4:
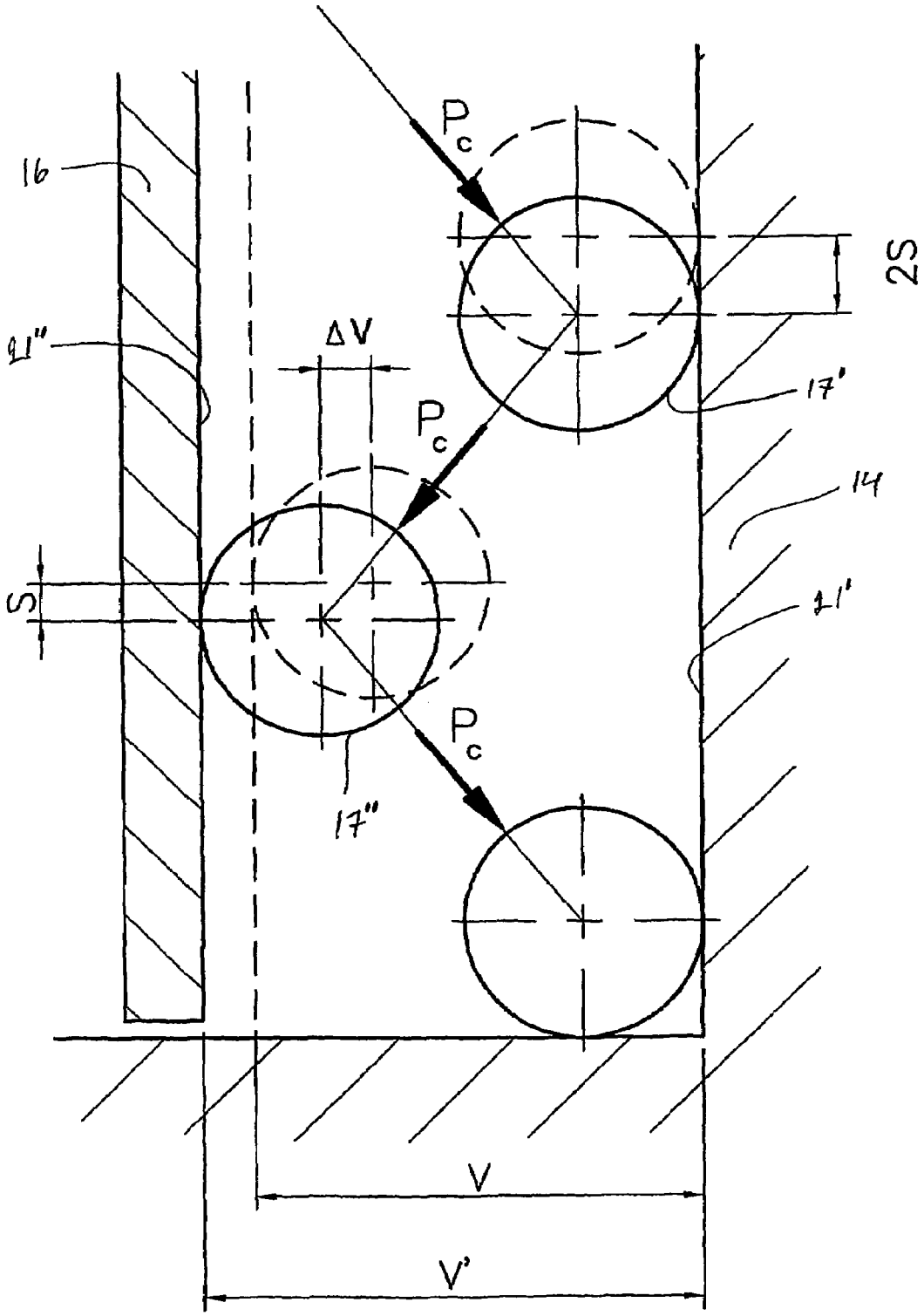
Figure 5:
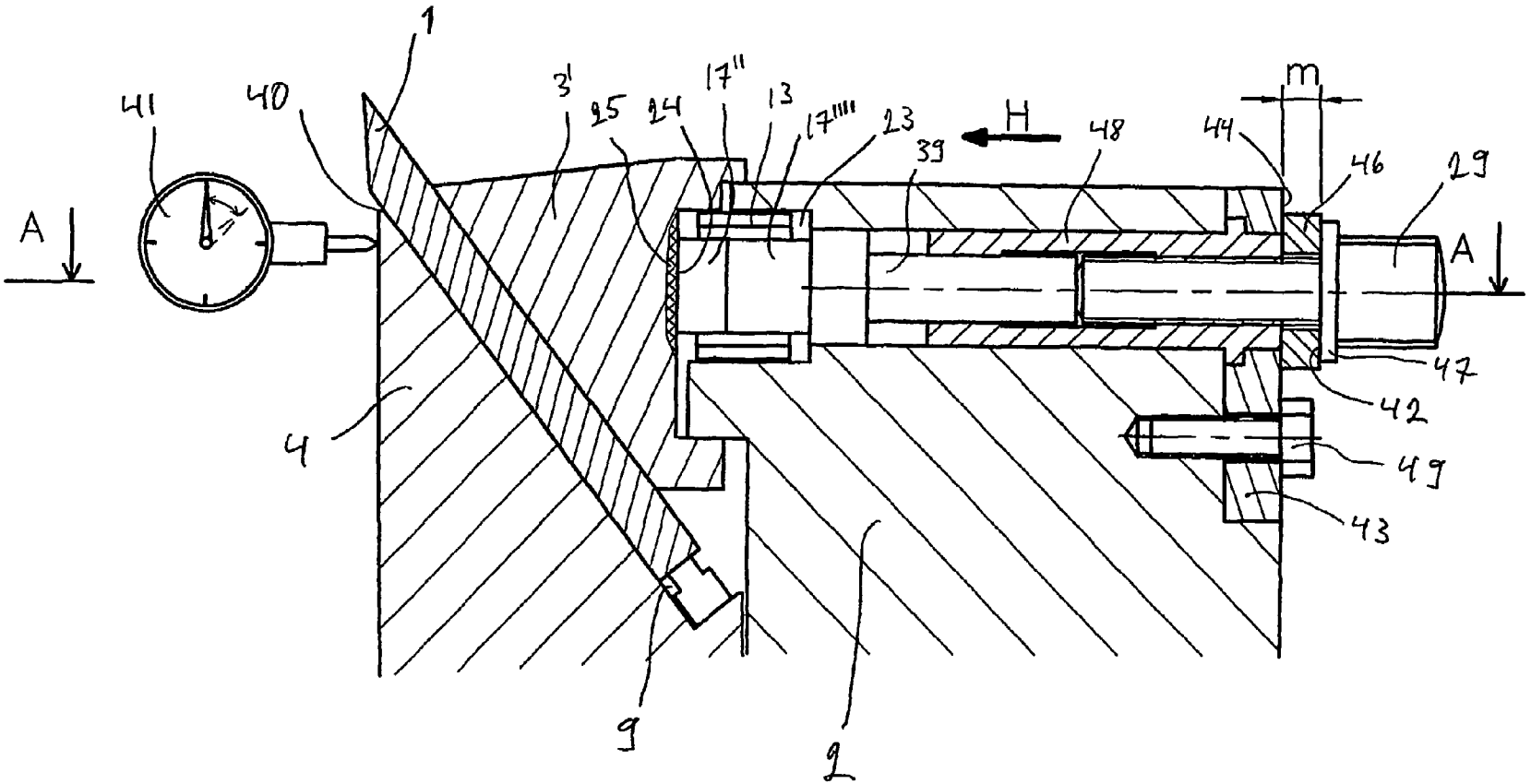
Figure 6:
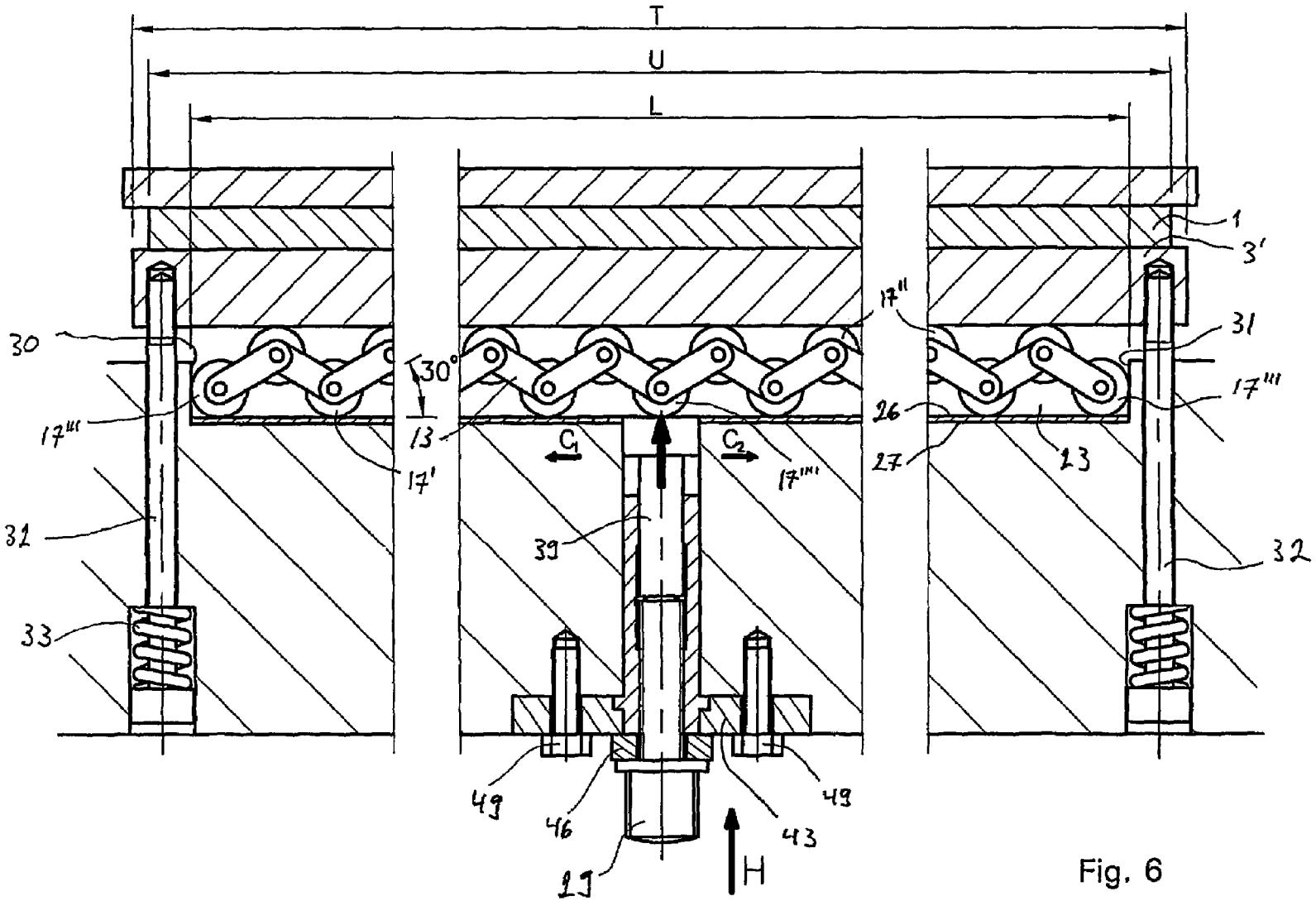
Figure 7:
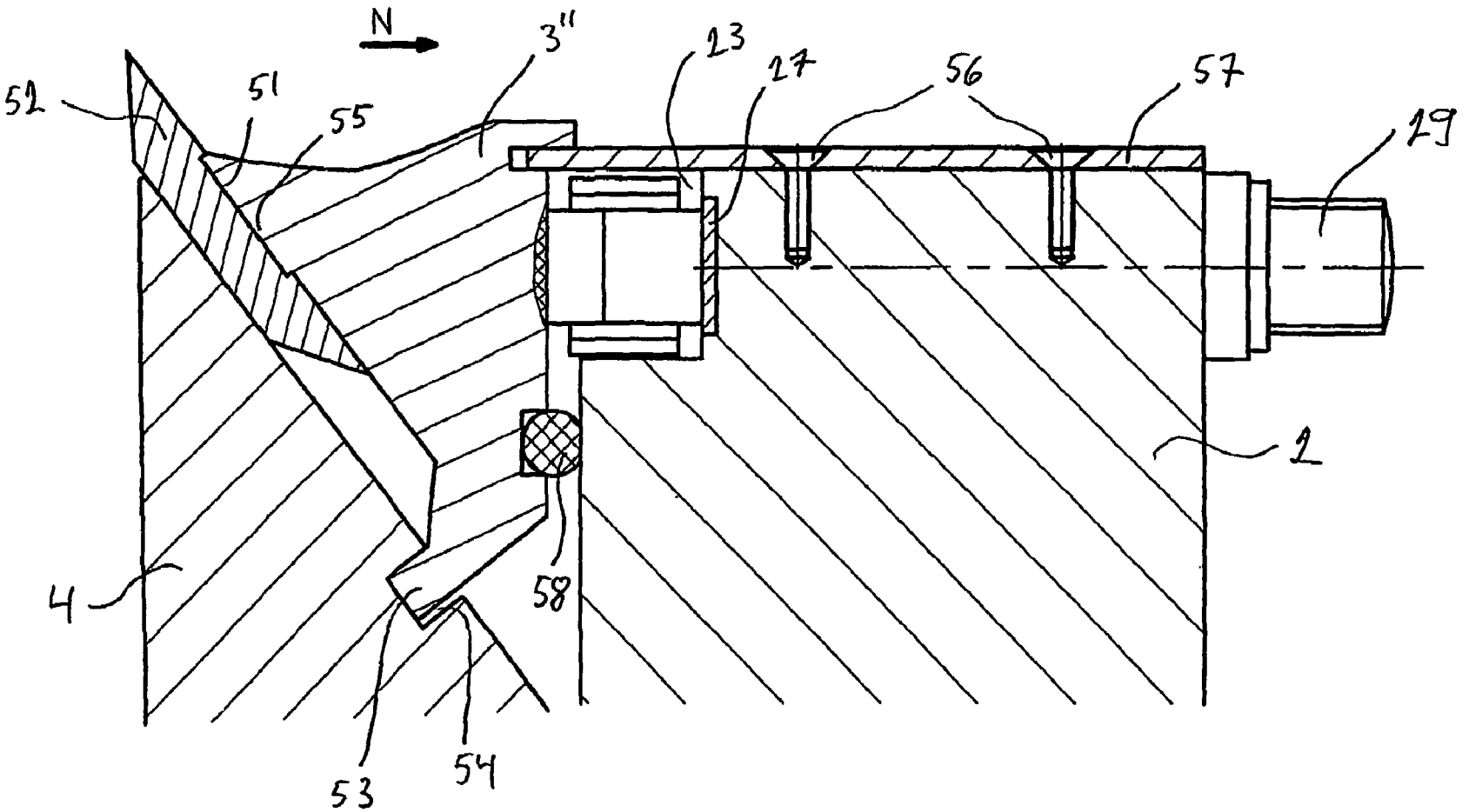
Figure 8:
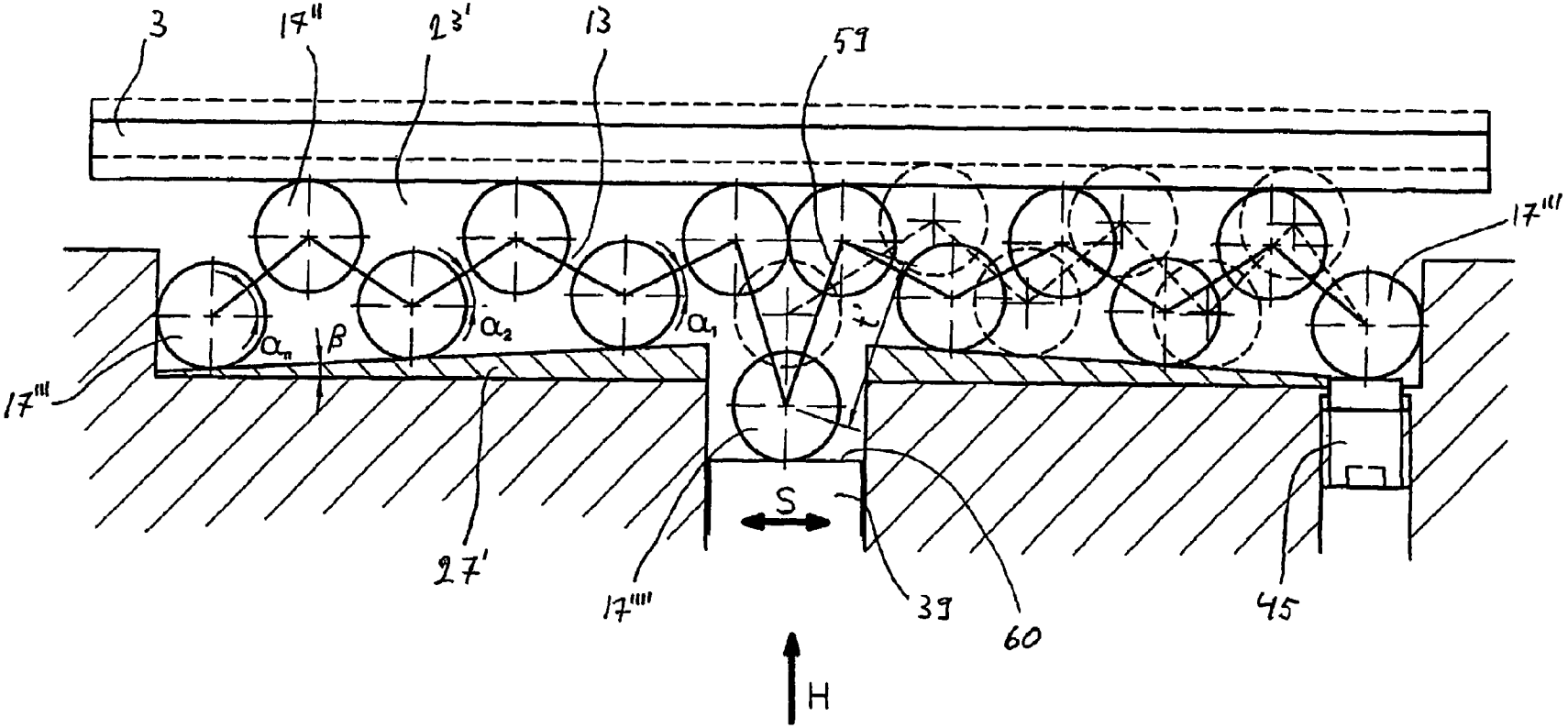

The present invention and its details will now be described in more detail, with reference to the enclosed drawings, where FIG. 1 shows a traditional attachment of a one-part knife to a knife disc, FIG. 2 shows a pressing method according to the present invention, FIG. 3 shows the construction of a roller chain used in the present invention, FIG. 4 describes operation of the pressing method according to the present invention, FIG. 5 shows a method according to the present invention for fixing the knife, FIG. 6 shows section A-A of FIG. 5, FIG. 7 shows a method according to the present invention for a turn knife, FIG. 8 shows an alternative embodiment of the present invention, In a traditional knife attachment, as described in FIG. 1, a one-part knife 1 is attached to the knife disc 2 between a knife clamp 3 and a wear plate 4. Knife 1 is pressed by means of the knife clamp, bolt 5 and nut 6 against the wear plate 4. The wear plate 4 is attached to the knife disc with a plurality of bolts 7 and nuts 8. The knife clamp 3 is pressed e.g. by means of seven adjacent bolts 5 (only one shown in figure). For changing the knife 1, bolts 5 are loosened, whereby the knife clamp 3 moves in the direction of arrow N. The knife is lifted from its knife recess 9 and a sharpened knife is put instead, after which the bolts 5 are tightened. The knife clamp is supported in a tangential direction of the knife disc 2 by means of a shoulder 10 in the knife disc and a shoulder 12 and a groove 11 in the knife clamp. Then the knife disc 2 is turned so much that the following knife comes to the working area for knife changing. All the knives are changed in the same way. For loosening and tightening the knives 1, robust tools are required. Mostly used is a compressed air screwdriver with moment adjustment, by which the bolts can be tightened into a predetermined moment. In the practice two men take care of the chipper knife change shown in FIG. 1, whereby one of them changes knives at the front side of the chipper and the other loosens/tightens bolts on the other side of the knife disc 2.

Fixing of knifes in a disc chipper requites a pressing force evenly distributed along the knife, and therefore the following concentrates to the details of the roller chain used in the invention. FIGS. 2, 3 and 4 show a pressing method in accordance with the present invention. The method is based on using a roller chain 13 between two surfaces. In FIG. 2, the massive portion 14 forms a pressing housing, where the elements 15 and 16 to be pressed are located. Element 16 distributes the pressing force evenly forming simultaneously a roller surface against the rollers 17 of the roller chain 13.

FIG. 3 shows in detail the construction of the roller chain 13. By using a roller chain according to the drawing, a prominently wider range of use of the invention can be reached.

The roller 17 of the roller chain must be able to receive considerable pressing forces and thus it must have a big diameter D and a hardness value corresponding to the hardness of ball bearings, that is about 60 HRC.

According to FIG. 3, the roller 17 is supported on the bushing 19 of the inner links 18 and inside the bushing 19 there is a fulcrum pin 20 of the outer links 22. In the construction of the roller chain, in addition to the hardness of the rollers 17, it must also betaken into account, that the plain bearing friction against the bushing 19 is minimal. Low friction is achieved by lubrication and a big diameter ratio D:d. Slide friction is also formed between the fulcrum pin 20 and the bushing 19. The influence of said friction is, however, prominently smaller, because the effective torque arm is in that case section t of the chain and the braking friction force is on the radius e:2. Effect of the roller friction is minor and decreases with increasing diameter D.

The method with a roller chain is described in FIG. 2 as a frictionless model construction that can nearly be achieved by applying ball bearings in places of plain bearings. With a frictionless construction the basic operation of the invention will be brought out best. According to FIG. 2, the pressing forces P to each roller on top of the force arrows on the sides of the pressing housing are unchanged from one roller to another in a frictionless system. The initial force $P_o$ applied to the roller chain 13 moves unchanged in its direction of application in a system according to FIG. 2, and the pressing forces per roller are generated by the changes of direction of the force.

FIG. 4 describes the pressing method according to the present invention and the FIG. 2 in more details. The distance v between the roller surfaces 21' and 21" of the elements 14 and 16 increases from dimension v to dimension v'. At the same time the roller 17" moves a distance Δv in the pressing direction and a distance s in the longitudinal direction of the device, and the roller 17' moves a distance 2s in the longitudinal direction of the device. The rollers roll when moving along the roller surfaces 21' and 21". At the same time, a limited turning or angle change takes place in the couplings of the chain 13 (elements 19 and 20). In a frictionless system each of the rollers receives an equal pressing force P against the pressing surfaces.

It has been reported in realized tests, that the efficiency in the power transmission with the construction of the chain 13 of FIG. 3 and coupling angles ϵ of 90° from one roller to another is preferably about 95%, in other words, factor k of FIG. 2 is in that case 0.95. Factor k is mainly dependant on the diameter ratio between the roller and the bushing, on the angle between the couplings and to a certain extent on the roller friction and the fulcrum pin friction. Coupling angles less than 90° decrease the efficiency of the power transmission rapidly, and with long tightening distances it is often preferable to use a coupling angle ϵ of about 120°.

Due to the construction and lubrication of the roller chain, the factor k is between 0.80 and 0.96 with a plain bearing construction. With ball bearings k=0.98 can be achieved. With the above mentioned values it can be calculated, that in a system comprising 10 rollers, the pressing force of the last roller is $k^{10}$. Factor k=0.95 gives the force of the last roller=0.60, which is about 60% of the initial force. After the initial tightening, the force will be equalised by the dynamic loading or vibration. The forces can also be equalised to a certain extent by using a vibrating force generating method and by loosening the tightening force after the strongest force has been reached.

The invention is directed to the use of the roller chain as a part of a fixing system for chipper tools, whereby each of the 10 to 16 chipper tools is to be subjected by a pressing which is equal along the whole active cutting length of the tool. The length on which the pressing is affecting is thus considerable long. It is often preferred to apply the force to the central portion of the roller chain 13. Several points for application of the force make the use of the invention more complex. The ideal mode to use the invention presupposes the application of the force to the central portion of the roller chain by means of a tightening bolt 29, as shown in FIG. 6, whereby equally big forces are distributed towards the both ends of the roller chain.

The most critical problem in using the roller chain 13 under pressure is the control and determining the resulting pressing force. In this connection the torque moment of the tightening bolt 29 is not applicable, because the torque moment in several cases diminishes at the end of the tightening operation. Because the development of the actual pressing force depends on several factors, and even small deviations in the dimensions of the chipper parts lead to severe deviations in pressing forces, involves the new tightening method according to the invention a solution to these problems, which easily is applicable in chippers for achieving rapid tool changing operations.

In accordance with the invention the roller chain is positioned within a space L, which in longitudinal direction is stationary, whereby the end rollers 17''' are immobilized, and the part 3 which in connection with several rollers 17" is achieving the actual pressing work under a considerable force in a comparative short displacement movement, when one or two of the rollers 17' on the opposite side are pressed to the pressing direction H by means of a separate element 39 having a long actuating stroke, and by means of a pressing bolt 29 (FIGS. 5 and 6).

In accordance with the invention the tightening force is indicated by means of the bending of the tip of the wear plate, as depicted in FIG. 5. The bending is measured for instance at a point situated 5 mm from the tip 40 of the wear plate using a metering instrument 41. A proper tightening is determined for instance using a traditional tightening method described in FIG. 1. When the bending is determined, the bolt in FIG. 5 is tightened to a point where the measuring instrument indicates a proper value. A common value for the bending is about 0.05 to 0.20 mm. Then the distance m between the abutting surface 42 of the bolt's 29 head is measured. The distance m is determined at each knife, and the control bolt 45 presented in FIG. 8 is used to adjust the measure m to be equal at each knife. Then a washer 46 is made and mounted. The knifes are tightened by means of the toque moment of the bolt 29, which exceeds 30 to 50% of the actual tightening moment. Loosening of the bolts is prevented by means of the additional friction caused by the deviation 47 of the bolt head.

The level of the pressure force of the rollers can also be effected to by making the distance v variable or wedge-shaped and by changing the distance t between the fulcrum pins 20 of the roller chain. From the point of view of manufacturing, however, the later alternative leads to a more complicated construction, which increases problems with service and the risk of mistakes.

An ideal usage of the method of the present invention is for fixing long knifes of wood chippers. In that case a knife from 600 mm to 1000 mm can be attached from one point. The active cutting part of a knife begins 50 to 100 mm from the end of the knife. A decreasing pressing force can be allowed for the 50 to 100 mm part at the knife ends. The force required for attachment of the knives is very big, exceeding 500 kN. The force application path, however, is small being about 1 mm comprising motion from zero to the maximum force. Based on that it can be calculated, that the attaching energy is only 0.25 kNm. In order to achieve the same effect in prior art knife fixing assemblies, from 10 to 14 bolts are often used thereto, the loosening of which is troublesome and hard to be mechanised. By means of the method of the present invention the required attaching work can be performed in one place with a power of 10 to 50 kN, the extend of displacement being from 10 to 50 mm. It can be understood, that mechanising or automating of this single operation per each knife is much easier.

A fixing method in accordance with the present invention will now be described with reference to FIGS. 5 and 6. Knife 1 is pressed in its place in the knife recess 9 by a knife clamp 3'. Length T of the knife clamp 3' is bigger than the length U of the knife 1. The knife clamp 3' is pressed against the knife 1 by means of a roller chain 13. Chain 13 is located in a chain recess 23 between the knife clamp 3' and the knife disc 2. The roller chain 13 is in contact with the knife clamp 3' almost over the total length of the knife clamp. The method provides an equal pressing force to be applied to the knife 1 over the total length U of the knife. The pressing surface 24 of the knife clamp 3' has been hardened 25 in order to avoid deformations due to the surface pressure caused by the rollers of the chain. The pressing surface 26 of the knife disc 2 is formed by a rail 27 or rails fixed to the disc.

When tightening the bolt 29 in the middle portion of the knife, the bolt moves in the direction of arrow H, whereby a pressing force is applied to the roller 17"" of the chain next to the bolt 29. The walls 30 and 31 at the ends of the chain housing prevent the chain 13 from spreading in the direction c1 and c2, whereby the rollers 17" of the chain in contact with the knife clamp 3' press the knife clamp against the knife 1.

The tightening bolt 29 is abutting to a sleeve 48, which is fixed in a recess in the knife disc 2 with a locking plate 43 and bolts 49. The tightening bolt is pressing the chain roller 17"" next to it with an intermediate element 39 (pusher) situated freely in the pressing direction movable in the sleeve 48.

For removing the knife easily from its recess, a movement of about 1,5 mm against the direction of the arrow H is required for the knife clamp 3'. In big sized disc chippers the tightening chain of the knife clamp can comprise 20 chain links. When the chain links have an angle of 30° with respect to the pressing surfaces (as shown in FIG. 6), a movement of about 15 mm, again in the opposite direction to the arrow H, is required for the tightening bolt 29 and for the coupling of the chain link located next to the tightening bolt, whereby the chain releases the knife clamp to move the needed 3 mm.

The knife clamp (base) 3' is attached at its ends to the knife disc with bolts 32. Between the bolt head and the knife clamp there is a spring 33 pressing the knife clamp against the knife disc, when the chain 13 is not tightened by the bolt 29. Thus, when the knife has been removed from its knife recess, the cleaning of the knife recess and mounting of a new knife is easy.

FIG. 7 shows an application of the method for a turn-knife system. Length of a turn knife 52 with a low adjustment groove 51 is usually only a half or a third of the length of a normal knife. The one-piece knife clamp 3" is supported by a lug 53 to the recess 59 of the wear plate 4. The turn knife is adjusted in its place by means of the low groove 51 and a projection 55 of the knife clamp 3". For adjusting the knife also other known methods can be used. Some turn-knife systems are characterised in, that the knife clamp or a corresponding part for pressing the knife must be moved a relatively long way. A long movement is necessary in order to get the strongly shaped knife out of the recess. In this kind of cases the method of the invention can be used in accordance with the arrangement of FIG. 8.

The embodiment of FIG. 7 show also a protective plate 57, which is fixed using flat-head bolts 56, as well as a compressible seal 58 in the groove between the knife disc 2 and the part 3". The seal prevents the small cuttings formed in the chip production to migrate to the chain recess 23.

FIG. 8 shows an assembly according to the invention providing a longer displacement for the part 3' in the direction H. The longer displacement can be achieved by providing the middle roller in the roller chain 13 with two longer t' couplings 59. The displacement movement of the part 3' can thus be essentially increased.

The embodiment of FIG. 8 describes further a chain recess 23' having a lower middle part due to an insert 27'. The insert is intended to amend the angle $\alpha$ of the chain couplings so that the friction dependent decrease of the pressing force is equalized due to the increase in the angle $\alpha(\alpha_{n+1}>\alpha_n)$. According to the rules of mechanics the chain force P is deviated so that the force in the direction H increases when the angle $\alpha$ increases. Then the arrangement according to FIG. 8 achieves a system where the friction in the chain links is compensated and the pressing force will be equal. As the friction in the chain varies, and the influence of vibration to the equalization of the forces is essential, a proper value for the wedge angle β is to be determined empirically.

The adjusting properties for the chipper knifes are adjusted to the same level using an adjusting bolt 45 positioned beneath the end roller 17'''. Due to the inaccuracy in the measuring and the use of the adjusting bolt 45, the middle roller must be displaceable on the surface of the pusher 39 in the direction of the arrow s. The head of the pusher 39 must then be furnished with a hardened planar rolling surface 60.

The invention claimed is:

1. A method for fixing a knife in wood chipper apparatuses over the whole knife length between two firm surfaces, wherein the method comprises the step of compressing said firm surfaces towards each other by means of a force exerted essentially perpendicular to said firm surfaces, wherein the force compressing said firm surfaces is developed by compressing a roller chain having a length longitudinally towards two end stops in a space limited by two end stops and two counter surfaces lying essentially parallel to said two firm surfaces, each link of the chain having a roller wherein each roller is in contact with a counter surface that is different from the counter surface each adjacent roll is contacting, so that the force applied to the roller chain affects multiple points of the counter surfaces thus forming a prominent total pressing force.

2. A pressing method according to claim 1, wherein the force developed brought to the roller chain is adjustable or removable by means of a threaded bolt.

3. A pressing method according to claim 2, wherein the pressing force is developed between two firm surfaces diverging from each other in the direction away from the point where the external force is applied.

4. A pressing method according to claim 2, wherein the position of at least one of the end stops is adjusted.

5. A pressing method according to claim 1, wherein a proper level for the pressing force is determined in accordance with the degree of yield of one of the firm surfaces, and its recurrence is secured with a limiting element corresponding to this level.

6. A pressing method according to claim 5, wherein the pressing force is developed between two firm surfaces diverging from each other in the direction away from the point where the external force is applied.

7. A pressing method according to claim 5, wherein the position of at least one of the end stops is adjusted.

8. A pressing method according to claim 1, wherein the pressing force is developed between two counter surfaces diverging from each other in the direction away from the position of the at least one roller.

9. A pressing method according to claim 8, wherein the position of at least one of the end stops is adjusted.

10. A pressing method according to claim 1, wherein the position of at least one of the end stops is adjusted.

11. A pressing method according to claim 1, wherein the compressing force urges at least one of the rollers at a middle section of the length of the roller chain to deviate its position relative to the plane of one of the counter surfaces perpendicularly towards the opposite counter surface.

12. A knife system of a disc chipper having a long knife, the chipper comprising:

a knife disc, a wear plate, a knife base and a knife, wherein between the knife disc and the knife base there is provided a roller chain for forming a pressing force that presses the knife base towards the knife, the force being developed by compressing said roller chain longitudinally in a space formed as a coincident recess on the knife disk and the knife base, respectively, each link of the chain having a roller wherein each roller is in contact with a surface that is different from the surface each adjacent roll is contacting.

13. A knife system according to claim 12, wherein the force directed to the roller chain is applied by means of a pressing bolt and a pusher in the pressing direction.

14. A knife system for chipper according to claim 13, wherein the knife disk is furnished with a wedge shaped insert towards the roller chain.

15. A knife system according to claim 13, wherein the pressing bolt is furnished with a washer between the knife disk and the bolt head.

16. A knife system according to claim 15, wherein the knife disk is furnished with a adjusting bolt acting in the pressing direction at the point of an end roller of the roller chain.

17. A knife system for chipper according to claim 15, wherein the knife disk is furnished with a wedge shaped insert towards the roller chain.

18. A knife system according to claim 13, wherein the knife disk is furnished with a adjusting bolt acting in the pressing direction at the point of an end roller of the roller chain.

19. A knife system for chipper according to claim 18, wherein the knife disk is furnished with a wedge shaped insert towards the roller chain.

20. A knife system for chipper according to claim 12, wherein the knife disk is furnished with a wedge shaped insert towards the roller chain.

21. A knife system for chipper according to claim 12, wherein the system includes a means to urge at least one of the rollers at a middle section of the roller chain to deviate its position relative to the plane of the knife disc perpendicularly towards the knife base.

* * * * *